US008280273B2

(12) United States Patent
Kamimura et al.

(10) Patent No.: US 8,280,273 B2
(45) Date of Patent: Oct. 2, 2012

(54) PROCESS CARTRIDGE, IMAGE FORMING APPARATUS AND DEVELOPING CARTRIDGE

(75) Inventors: Naoya Kamimura, Ichinomiya (JP); Fumikazu Sato, Konan (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/396,162

(22) Filed: Feb. 14, 2012

(65) Prior Publication Data

US 2012/0141170 A1 Jun. 7, 2012

Related U.S. Application Data

(63) Continuation of application No. 12/340,956, filed on Dec. 22, 2008, now Pat. No. 8,135,300.

(30) Foreign Application Priority Data

Dec. 28, 2007 (JP) ..... 2007-340755

(51) Int. Cl.
*G03G 15/00* (2006.01)
*G03G 15/08* (2006.01)

(52) U.S. Cl. ..... 399/90; 399/119

(58) Field of Classification Search ..... 399/88, 399/90, 111, 113, 119
See application file for complete search history.

(56) References Cited

U.S. PATENT DOCUMENTS

| | | | |
|---|---|---|---|
| 7,079,783 | B2 | 7/2006 | Yokoi |
| 7,248,810 | B2 | 7/2007 | Miyabe et al. |
| 7,412,188 | B2 | 8/2008 | Ishii et al. |
| 7,599,640 | B2 | 10/2009 | Sato |
| 7,613,414 | B2 | 11/2009 | Kamimura |
| 7,912,403 | B2 | 3/2011 | Kim et al. |
| 2007/0071480 | A1 | 3/2007 | Ishikawa |

FOREIGN PATENT DOCUMENTS

| | | | |
|---|---|---|---|
| JP | 2001-228686 | A | 8/2001 |
| JP | 2007-108691 | A | 4/2007 |

*Primary Examiner* — Robert Beatty
(74) *Attorney, Agent, or Firm* — Banner & Witcoff, Ltd.

(57) ABSTRACT

A process cartridge, which includes a developing cartridge and a photosensitive cartridge for use with an image forming apparatus including a driving force output part and a feeding part, is provided. The developing cartridge includes a developer carrier, a first electrode provided at one side thereof, and a driving force receiving part provided at another side thereof and aligned with the first electrode such that the driving force receiving part overlaps the first electrode in a side view. The photosensitive cartridge, to which the developing cartridge is removably mounted, includes a photosensitive member, and a second electrode that contacts the first electrode when the developing cartridge is mounted in the photosensitive cartridge and that contacts the feeding part when the photosensitive cartridge is mounted in the image forming apparatus. The first electrode is pressed toward the driving force receiving part by contact with the second electrode.

4 Claims, 11 Drawing Sheets

PROCESS CARTRIDGE, IMAGE FORMING APPARATUS AND DEVELOPING CARTRIDGE

CROSS-REFERENCE TO RELATED APPLICATIONS

This application is a continuation of prior U.S. application Ser. No. 12/340,956, filed Dec. 22, 2008, which claims priority from Japanese Patent Application No. 2007-340755 filed on Dec. 28, 2007, the entire subject matter of which is incorporated herein by reference.

TECHNICAL FIELD

Aspects the present invention relate to an image forming apparatus, a process cartridge removably mounted to the image forming apparatus and a developing cartridge removably mounted to the process cartridge.

BACKGROUND

There has been proposed a printer that prints an image electrophotographically, in which a process cartridge is removably mounted. The process cartridge includes a developing cartridge having a developing roller and a photosensitive cartridge to which the developing cartridge is removably mounted and which has a photosensitive drum.

In the related art printer, a developing bias is applied to the developing roller when forming an image.

For example, JP-A-2007-108691 describes a related art printer including a developing cartridge that is mounted to a process cartridge. When the cartridges are mounted to each other, a body side feeding member provided on a body of the process cartridge comes into contact with a conductive member on the developing cartridge. The conductive member is connected to the developing roller shaft. Thus, a developing bias is applied to the developing roller shaft from the body side feeding member.

The related art process cartridge of the related art printer, described above, has some disadvantages. For example, when the developing cartridge is mounted to the related art process cartridge, the body side feeding member provided on the body housing of the related art process cartridge needs to be brought into contact with the conductive member provided on the developing cartridge.

Thus, there is imposed a limitation on the body housing in relation to the layout of the body side feeding member and the conductive member which enables a contact therebetween. In addition, there is also imposed a limitation on the developing cartridge in relation to the layout of the conductive member and the body side feeding member which enables a contact therebetween. As a result, there is a disadvantage in that a large limitation is imposed on the layout of components.

SUMMARY

Illustrative aspects of the invention provide a process cartridge which can reduce the limitation imposed with respect to layout of components for application of a bias, so as to enable the application of a bias in a simple, easy and ensured manner. Illustrative aspects of the invention also provide an image forming apparatus to which the process cartridge is mounted and a developing cartridge that is removably mounted to the process cartridge.

According to a first illustrative aspect of the invention, there is provided a process cartridge for use with an image forming apparatus which comprises a driving force output part and a feeding part, the process cartridge comprising: a developing cartridge comprising: a developer carrier; a first electrode, which is provided at one side of the developing cartridge and extends in a first direction that is parallel to an axis of the developer carrier, and to which a bias is applied; and a driving force receiving part that is provided at another side of the developing cartridge and aligned with the first electrode such that the driving force receiving part overlaps the first electrode when viewed from a side of the developing cartridge; and a photosensitive cartridge to which the developing cartridge is removably mounted, and which is removably mounted within the image forming apparatus, the photosensitive cartridge comprising: a photosensitive member; and a second electrode that is positioned to contact the first electrode when the developing cartridge is mounted in the photosensitive cartridge, and to contact the feeding part when the photosensitive cartridge is mounted in the image forming apparatus, wherein the developing cartridge receives a driving force from the driving force output part to drive the developer carrier, and wherein the first electrode is pressed toward the driving force receiving part by contact with the second electrode. Incidentally, the first electrode may transfer the bias to the developer carrier.

According to a second illustrative aspect of the invention, there is provided an image forming apparatus comprising: an image forming apparatus main body; a driving force output part; a feeding part; and the process cartridge according to the first illustrative aspect.

According to a third illustrative aspect of the invention, there is provided a developing cartridge comprising: a developer carrier; a frame that accommodates the developer carrier and comprises a reinforcement member; an electrode that is provided on the frame on one side of the developing cartridge and extends in a first direction that is parallel to an axis of the developer carrier, the electrode for applying a bias to the developer carrier; and a driving force receiving part provided on the frame at another side of the developing cartridge for receiving a driving force to drive the developer carrier, wherein the electrode, the driving force receiving part, and the reinforcement member are aligned to overlap each other when viewed from a side of the developing cartridge.

According to the first illustrative aspect of the invention, the relay electrode is provided on the photosensitive cartridge. According thereto, when the developing cartridge is mounted to the photosensitive cartridge, the bias electrode is brought into contact with the relay electrode, while when the process cartridge is mounted to the image forming apparatus, the feeding part is brought into contact with the relay electrode, whereby feeding from the feeding part to the bias electrode is implemented via the relay electrode.

In addition, in the relative arrangement between the bias electrode of the developing cartridge and the feeding part of the image forming apparatus main body, even though the bias electrode and the feeding part are disposed freely with no relation therebetween, in the event that the relay electrode of the photosensitive cartridge is disposed in such a manner as to be brought into contact with both the bias electrode and the feeding part, feeding from the feeding part to the bias electrode can be implemented via the relay electrode.

According thereto, the limitation can be mitigated which would otherwise be imposed on the developing cartridge in relation to the layout of the bias electrode, and furthermore, the limitation can also be mitigated which would otherwise be imposed on the image forming apparatus in relation to the lay out of the feeding part which is disposed therein. As a result, the limitation can be mitigated which would otherwise be imposed on the whole image forming apparatus in relation to the layout of the components.

In addition, since the bias electrode can be disposed in any way, in the first illustrative aspect of the invention, the bias electrode and the driving force receiving part are disposed in such a manner as to overlap each other when they are projected in a first direction.

Accordingly, the developing cartridge can be positioned with good balance relative to the photosensitive cartridge in the first direction.

In the first illustrative aspect of the invention, the bias electrode is configured to be pressed toward a driving force receiving part side in the first direction by contact with the relay electrode.

According thereto, even though the driving force receiving part receives a driving force from the driving force output part, the developing cartridge can be positioned stably relative to the photosensitive cartridge using the pressure applied to the bias electrode by the relay electrode. Furthermore, not only can stable feeding be implemented from the relay electrode to the bias electrode but also the driving force from the driving force output part can more surely be received by the driving force receiving part.

According to the second illustrative aspect of the invention, in the image forming apparatus, the limitation imposed thereon in relation to the layout of the feeding part can be mitigated. Accordingly, the limitation imposed on the whole image forming apparatus in relation to the layout of the components can be mitigated.

In addition, the developing cartridge can be positioned in a stable manner relative to the photosensitive cartridge. Further, it is possible to feed from the relay electrode to the bias electrode in a more stable manner. Moreover, the driving force receiving part can receive the driving force from the driving force output part in a more ensured manner. According thereto, a stable image forming can be attained.

DETAILED DESCRIPTION

I. Exemplary Embodiments

Exemplary embodiments of the invention will now be described with reference to the drawings.

(Image Forming Apparatus)

Figure 1:
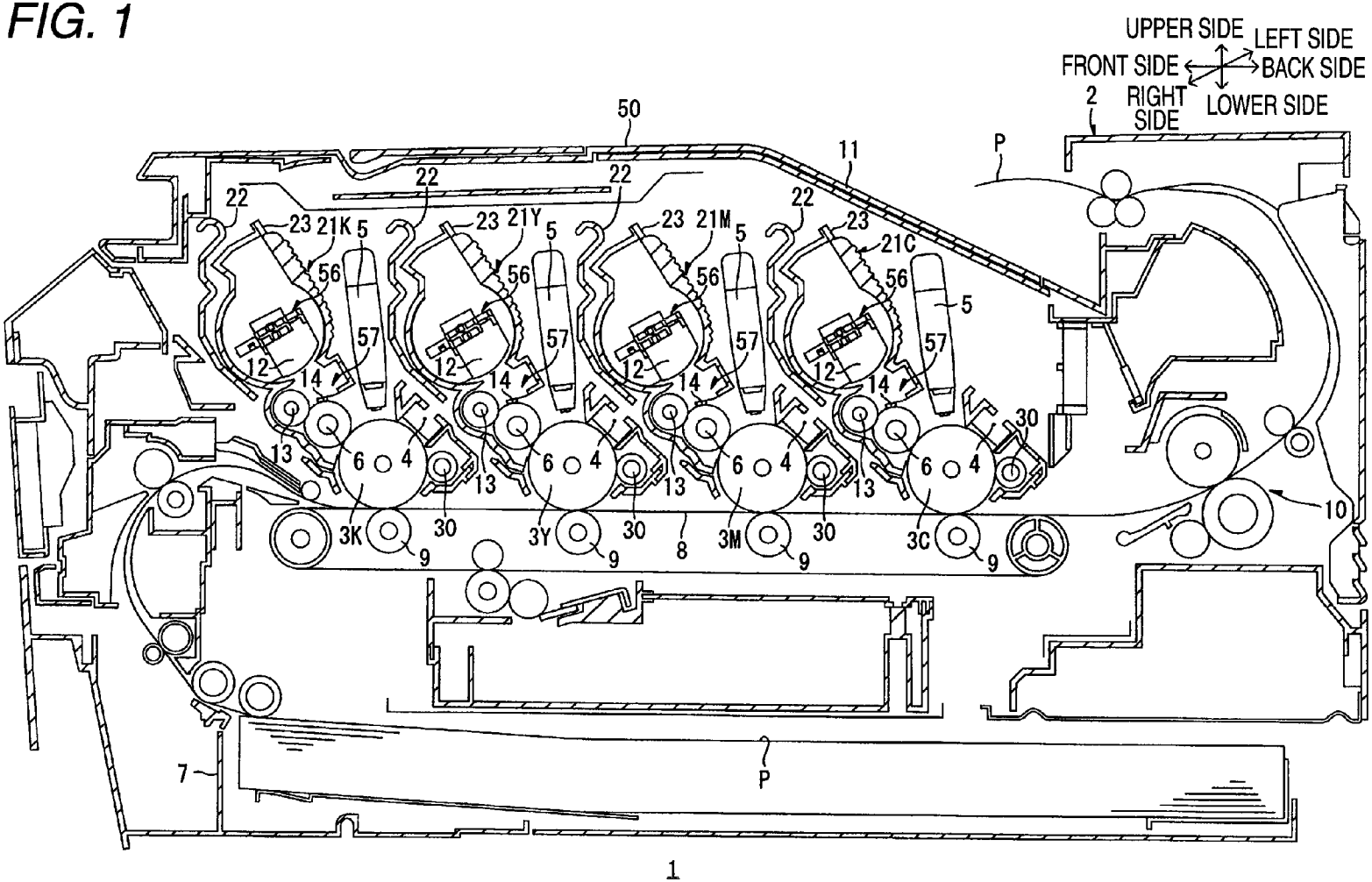
FIG. 1 a side sectional view showing an image forming apparatus according to an exemplary embodiment of the invention.

FIG. 1 is a side sectional view showing an image forming apparatus according to an exemplary embodiment of the invention. Note that, in the following description, when directions are mentioned, the directions refer to directions indicated by arrows in each of the accompanying drawings. In addition, a right-left direction and a width direction denote the same direction.

A color printer is one example of the image forming apparatus 1. As shown in FIG. 1, four photosensitive drums 3, which are an example of a photosensitive member, are disposed in parallel along a front-back direction within a body casing 2, which is an example of an image forming apparatus main body, of the image forming apparatus 1.

Hereinafter, the four photosensitive drums 3 will be distinguished from one another as a photosensitive drum 3K (black), a photosensitive drum 3Y (yellow), a photosensitive drum 3M (magenta), and a photosensitive drum 3C (cyan) which correspond, respectively, to developer images of respective colors (black, yellow, magenta and cyan). Each of the photosensitive drums 3 has a scorotron-type charger 4, a light emitting diode (LED) 5 and a developing roller 6 disposed adjacent to the photosensitive drum 3. The developing roller 6 is an example of a developer carrier.

The photosensitive drum 3 is charged uniformly on a surface thereof by the scorotron-type charger 4 and is thereafter exposed by the LED 5, whereby an electrostatic latent image based on image data is formed on the surface of each photosensitive drum 3. Each electrostatic latent image is visualized by developer carried on the developing roller 6, and a developer image is formed on the surface of the photosensitive drum 3.

Sheets P are accommodated within a sheet feeding cassette 7 within the body casing 2. The sheets P accommodated within the sheet feeding cassette 7 are individually fed to a conveyer belt 8 by various types of rollers.

The conveyer belt 8 is disposed between the respective photosensitive drums 3K, 3Y, 3M and 3C and transfer rollers 9 which face corresponding photosensitive drums. The developer images formed on the respective surfaces of the photosensitive drums 3 are transferred onto a sheet P which is being conveyed by the conveyer belt 8 by transfer biases which are applied to the respective transfer rollers 9 such that the images of the different colors are overlapped one on another sequentially.

The sheet P on which the four types of developer images have been transferred is then conveyed to a fixing part 10. The developer images which have been transferred onto the sheet P are thermally fixed at the fixing part 10. Thereafter, the sheet P is discharged on to a sheet discharging tray by various types of rollers.

(Process Cartridge)

The image forming apparatus 1 includes four process cartridges 21 which correspond to the respective colors. Note that in the following description, the four process cartridges 21 will be distinguished from one another according to their respective colors as a process cartridge 21K (black), a process cartridge 21Y (yellow), a process cartridge 21M (magenta) and a process cartridge 21C (cyan).

Each process cartridge 21 is removably mounted within the body casing 2 in such a manner as to be disposed in parallel along the front-back direction.

A top cover 50 is provided on an upper wall of the body casing 2 in such a manner as to be opened or closed, and by opening the top cover 50, the respective process cartridges 21 can be mounted into and removed from an interior of the body casing 2.

Figure 2:
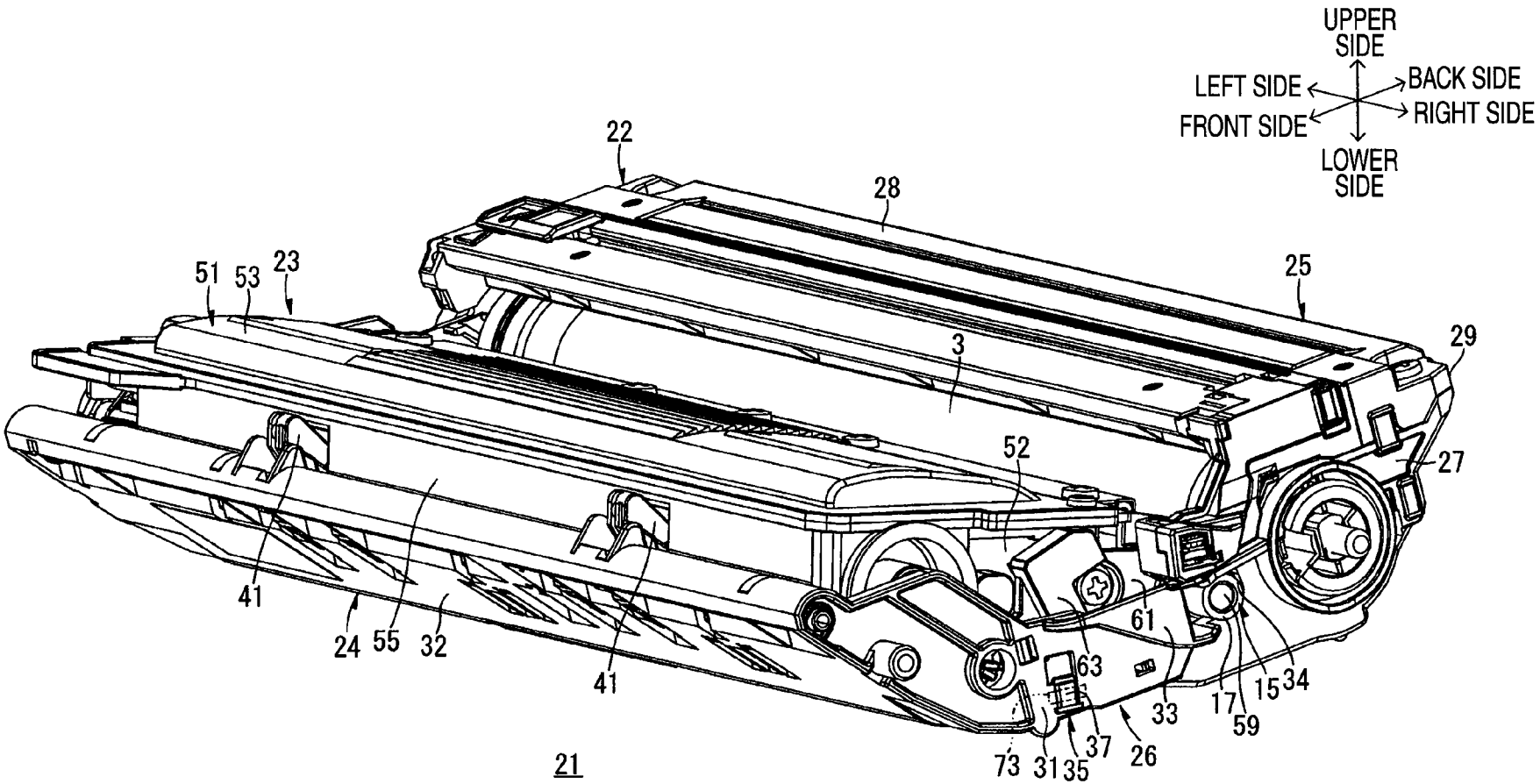
FIG. 2 is a perspective view of a process cartridge of FIG. 1 as viewed obliquely from a right front direction.
Figure 3:
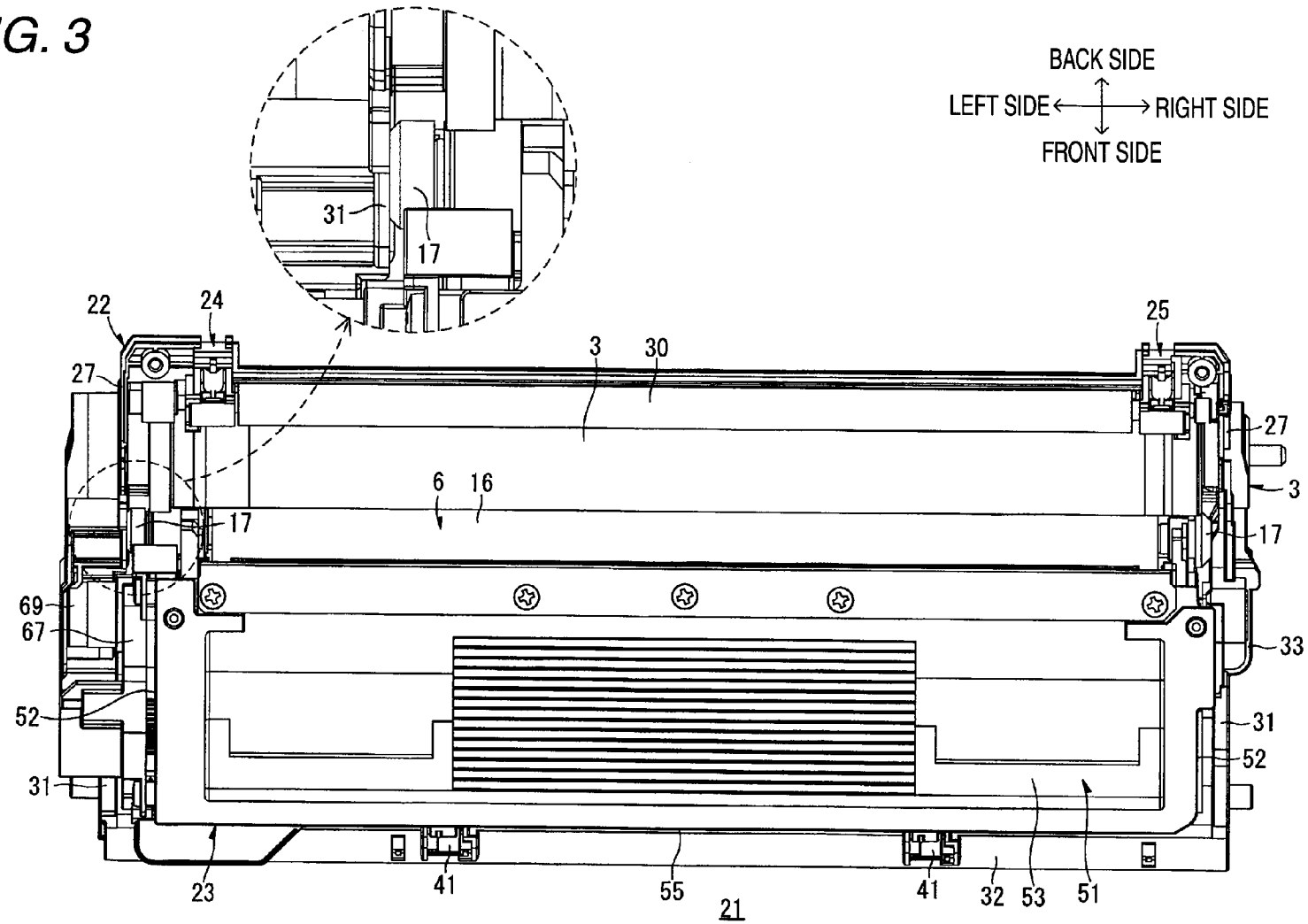
FIG. 3 is a plan view of the process cartridge of FIG. 2 with an upper wall of a drum cartridge removed.
Figure 4:
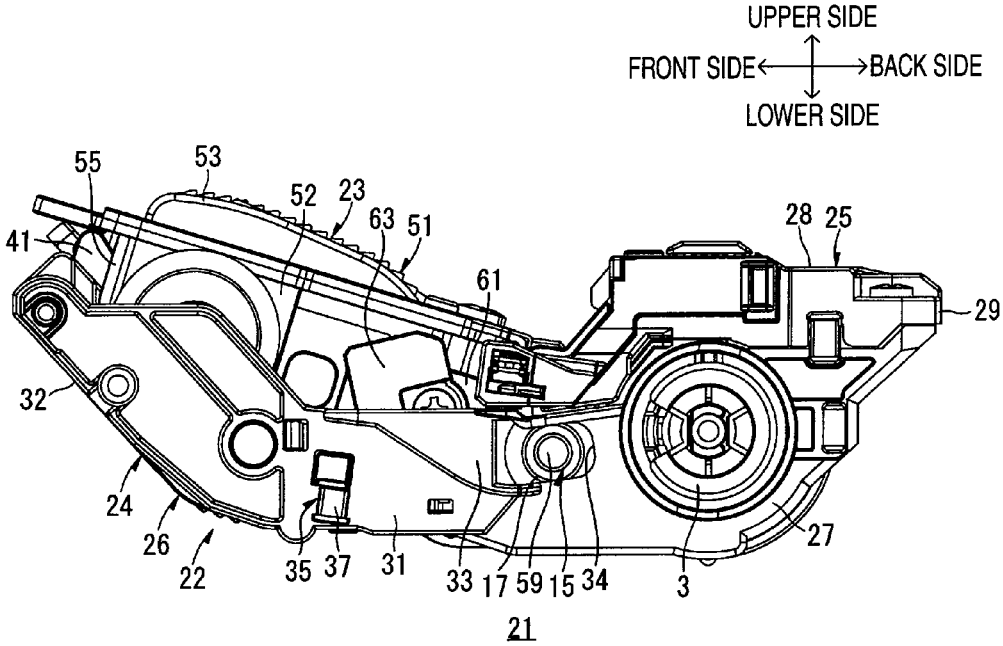
FIG. 4 is a right side view of the process cartridge of FIG. 2.
Figure 5:
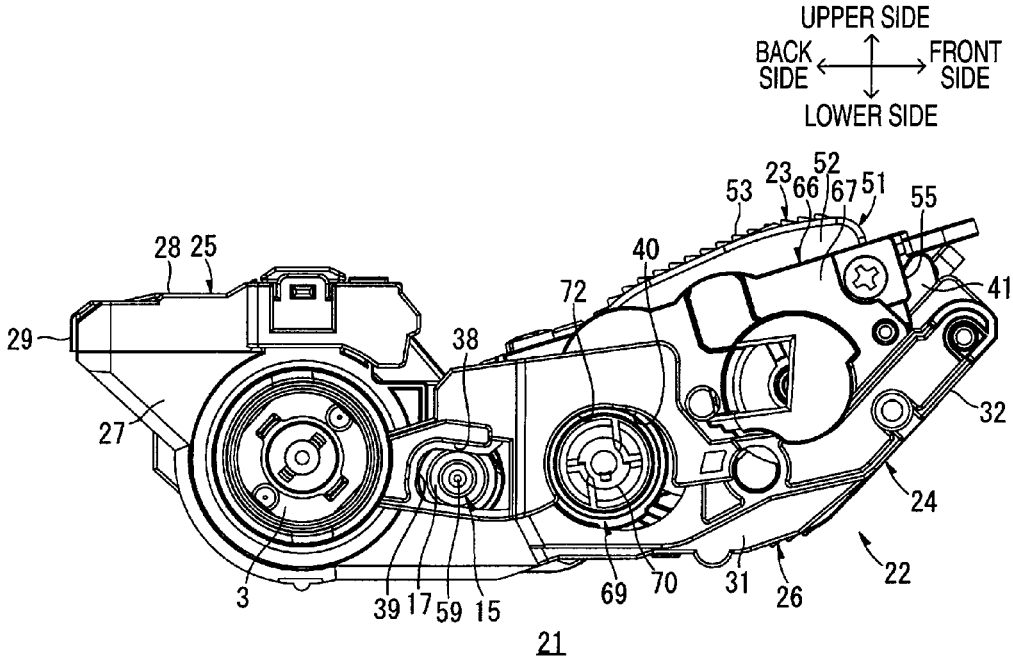
FIG. 5 is a left side view of the process cartridge of FIG. 2.

FIG. 2 is a perspective view of the process cartridge as viewed obliquely from a right front direction. FIG. 3 is a plan view of the process cartridge (with an upper wall of a drum cartridge removed). FIG. 4 is a right side view of the process cartridge. FIG. 5 is a left side view of the process cartridge.

The process cartridge 21 includes, as shown in FIG. 2, a drum cartridge 22 as an example of a photosensitive cartridge which is removably mounted within the body casing 2 and a developing cartridge 23 which is removably mounted to the drum cartridge 22.

(1) Drum Cartridge

Figure 6:
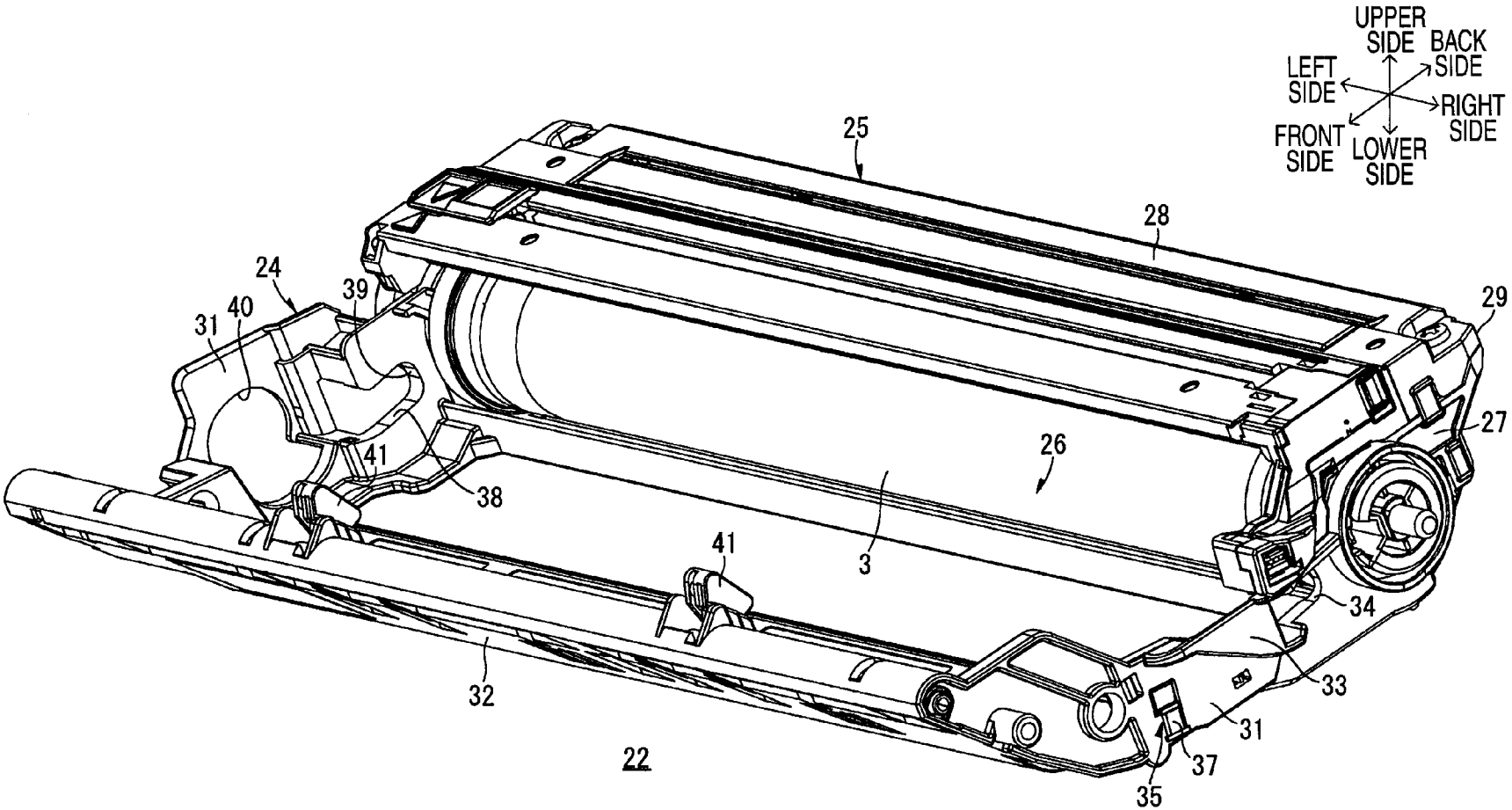
FIG. 6 is a perspective view of a drum cartridge of the process cartridge of FIG. 2 as viewed obliquely from a right front direction.
Figure 8:
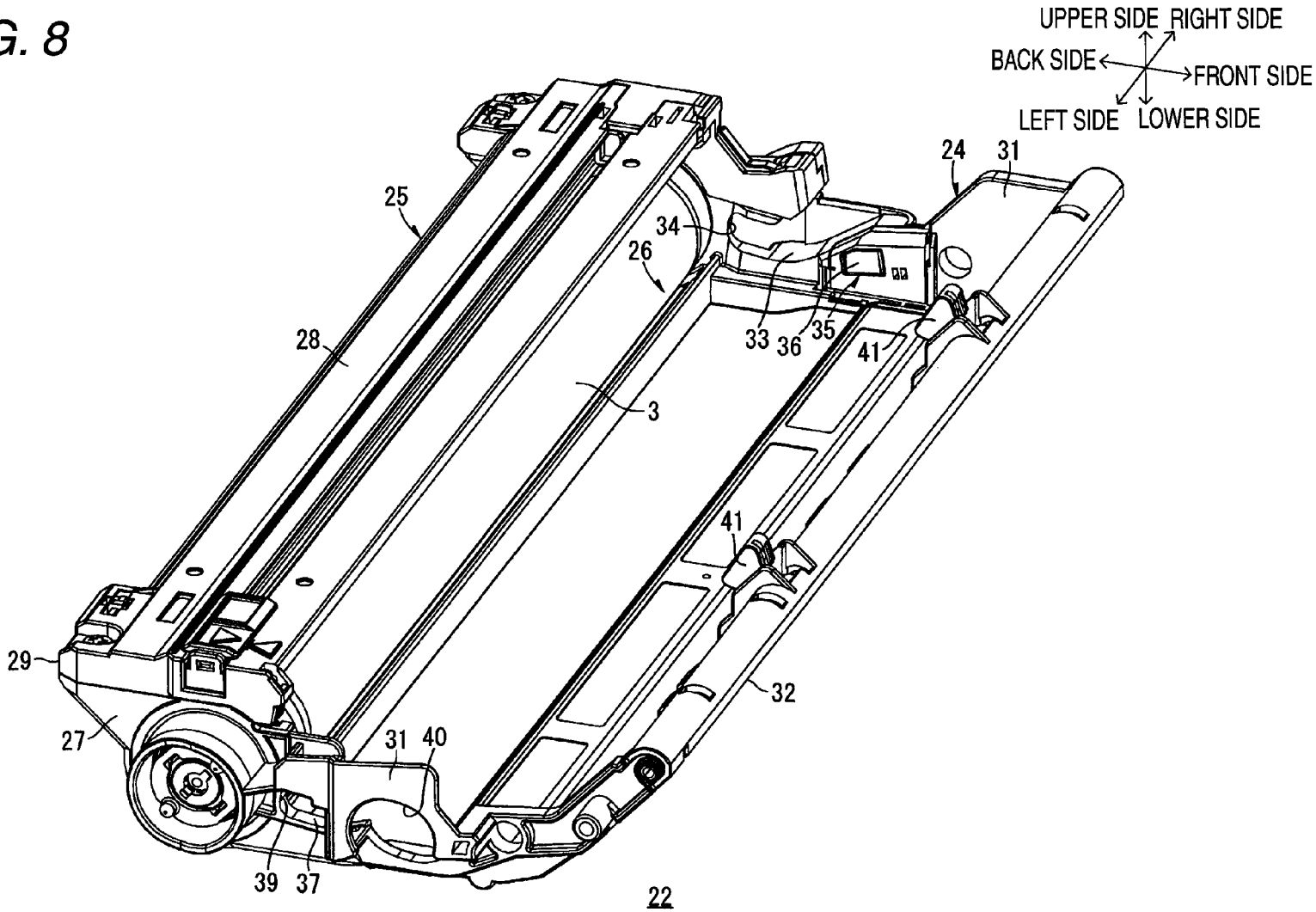
FIG. 8 is a perspective view of the drum cartridge of FIG. 7A as viewed obliquely from a left top direction.

FIG. 6 is a perspective view of the drum cartridge as viewed obliquely from a right front direction. FIG. 8 is a perspective view of the drum cartridge as viewed obliquely from a left top direction.

As shown in FIG. 6, the drum cartridge 22 includes a drum frame 24. The drum frame 24 includes a drum support part 25 and a developing cartridge accommodation part 26. The drum support part 25 includes a pair of rear side walls 27 which are disposed spaced apart from each other in a width direction in such a manner as to confront each other and an upper wall 28 which is provided in such a manner as to extend between upper end portions of the pair of rear side walls 27.

As shown in FIGS. 1 and 6, the photosensitive drum 3 is mounted between the pair of rear side walls 27 in such a manner as to be supported rotatably on the pair of rear side walls 27. In addition, the scorotron-type charger 4 is provided along the upper wall 28.

In addition, a rear wall 29 is provided at a rear end portion of the upper wall 28, and a cleaning roller 30 is supported rotatably between the pair of rear side walls 27.

The developing cartridge accommodation part 26 includes a pair of front side walls 31 which are disposed spaced apart from each other in such a manner as to confront each other so that the developing cartridge 23 can removably mounted in place therein and a front wall 32 which is provided in such a manner as to extend between front side portions of the front side wall 31.

The pair of front side walls 31 are formed in such a manner as to be continued from the pair of rear side walls 27. A rear portion of each front side wall 31 is formed in such a manner as to extend forwards from a lower side of a front end portion of each rear side wall 27, and a front portion of the front side wall 31 is formed in such a manner as to extend obliquely upwards as the front side wall 31 extends forwards from a rear portion thereof.

The front wall 32 is formed in such a manner as to be inclined obliquely upwards along lower end portions of the front portions of the pair of front side walls 31.

As shown in FIG. 8, a guide portion 33 for guiding a collar 17 (which will be described later) is formed on the rear portion of the right-hand front side wall 31 (one of the pair of side walls 31).

The guide portion 33 is formed in such a manner that the guide portion 33 is first inclined rearwards from an upper end of the front side wall 31 as the guide portion 33 extends downwards and then extends rearwards along the front-back direction. As shown in FIG. 6, the portion of the guide portion 33 which is inclined rearwards is formed in such a manner that the front side wall 31 swells outwards. As shown in FIG. 8, the portion of the front side wall 31 which extends rearwards along the front-back direction is formed as an opening which penetrates the front side wall 31 in the width direction.

A right-hand insertion hole 34 which receives the collar 17 rotatably is formed in a rear end portion of the guide portion 33 in such a manner as to be continued from the opening in the guide portion 33.

In addition, a relay electrode 35 is provided below the portion of the guide portion 33 which is inclined rearwards at the rear portion of the right-hand front side wall 31.

Figure 7B:
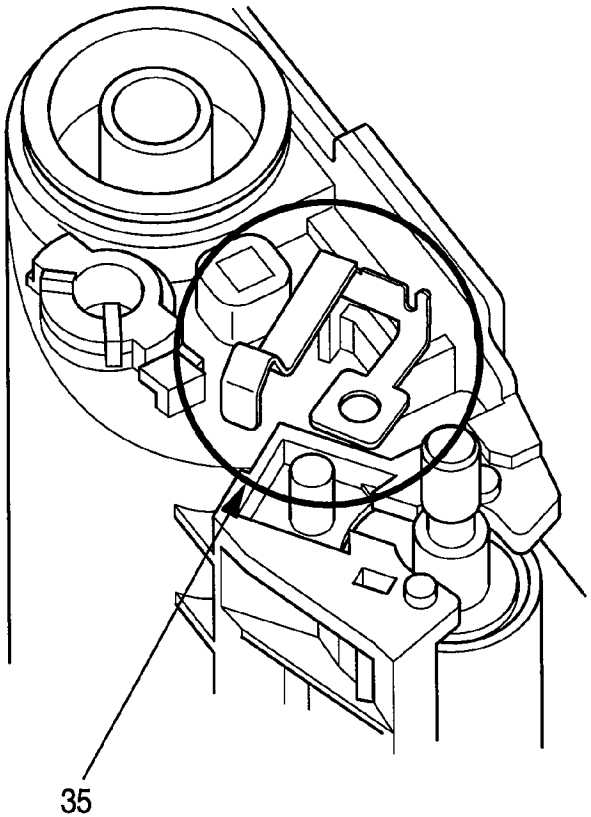
FIG. 7B shows connecting portions of the external electrode of FIG. 7A.
Figure 7A:
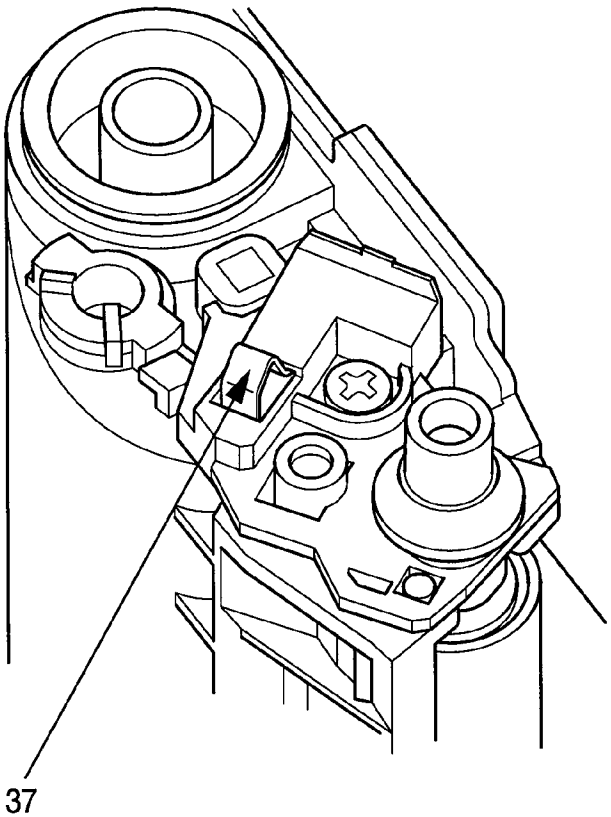
FIG. 7A is an enlarged view of the drum cartridge of FIG. 6 showing an external electrode.

The relay electrode 35 is embedded in the front side wall 31 and includes an internal electrode 36 which is exposed to an internal surface of the front side wall 31 and an external electrode 37 (refer to FIG. 6) which is exposed to an external surface of the front side wall 31. The internal electrode 36 has a substantially rectangular shape which is elongated in the front-back direction as viewed from the side. The external electrode 37 is disposed further forwards than the internal electrode 36 in the front-back direction as shown in FIG. 6 and has a substantially rectangular shape as viewed from the side. By an intermediate portion between the internal electrode 36 and the external electrode 37 being embedded in the front side wall 31, the relay electrode 35 is fixed to the front side wall 31. The relay electrode 35 may be screwed to the front side wall 31. FIG. 7A shows the external electrode 37, and FIG. 7B shows a schematic view of one example of the relay electrode 35. The relay electrode 35 is electrically conductive and may comprise a metal, for example.

In the relay electrode 35, the internal electrode 36 and the external electrode 37 are disposed in different positions in the front-back and up-down directions such that when the developing cartridge 23 is mounted to the developing cartridge accommodation part 26, the internal electrode 36 is brought into contact with a projecting portion 65 (which will be described later) of a bias electrode 62 in the width direction. When the process cartridge 21 is mounted to the body casing 2, the external electrode 37 is brought into contact with a body side electrode 73 (which will be described later) as an example of a feeding part in the width direction.

A guide hole 38 (see FIG. 6) for guiding a collar 17 (which will be described later) is formed in a rear portion of the left-hand front side wall 31 (the other front side wall 31).

In the left-hand front side wall 31, a front half portion of the rear portion is made to swell outwards, and the guide hole 38 is formed in a rear half portion of the rear portion. Specifically, the guide hole 38 is formed in such a manner as to extend rearwards from a stepped portion between the front half portion and the rear half portion of the rear portion and has a substantially L shape as viewed from the tope. The guide hole 38 is formed to have a width in the up-down direction which permits the passage of the collar 17 (which will be described later).

A left-hand insertion hole 39 which can receive the collar 17 rotatably is formed in a rear end portion of the guide hole 38 in such a manner as to be continued from the guide hole 38.

In addition, a coupling passage hole 40 which permits the passage of a developing coupling 68 (which will be described later) as an example of a drive output part which is provided on the body casing 2 is formed in a front half portion of the rear portion of left-hand front side wall 31 which lies further forwards than the guide hole 38. The coupling passage hole 40 has a substantially circular shape as viewed from the side.

In addition, when projected in the width direction, the coupling passage hole 40 is disposed in such a manner as to overlap the internal electrode 36. In other words, the coupling passage hole 40 is provided in the left-hand front side wall at a position across from a position of the internal electrode 36 on the right-hand front side wall 31.

Pressing members 41 are provided on the front wall 32 for pressing the developing cartridge 23 toward the photosensitive drum 3. The pressing members 41 are provided in two locations at a front end portion of the front wall 32 which are symmetrically spaced apart from each other in the width direction across a transverse center of the front wall 32. The pressing members 41 are supported at the front end portion of the front wall 32 in such a manner as to swing freely and are pressed upwards by springs (not shown).

(2) Developing Cartridge

Figure 9:
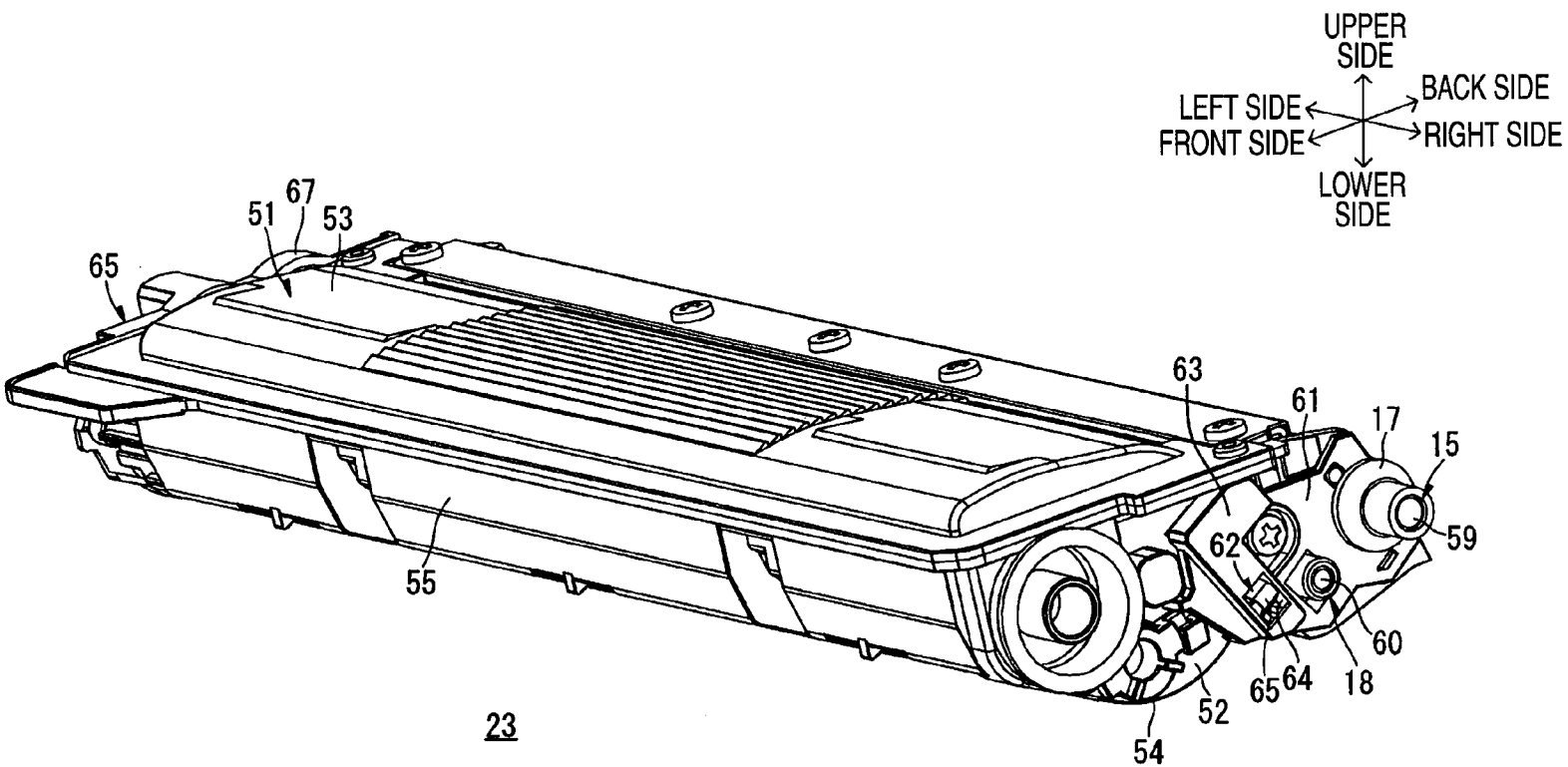
FIG. 9 is a perspective view of a developing cartridge of the process cartridge of FIG. 2 as viewed obliquely from a right front direction.
Figure 10:
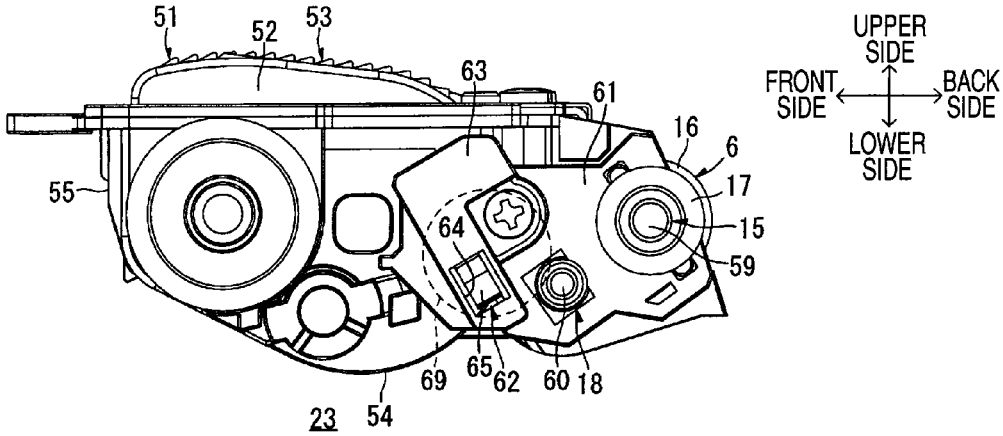
FIG. 10 is a right side view of the developing cartridge of FIG. 9.
Figure 11:
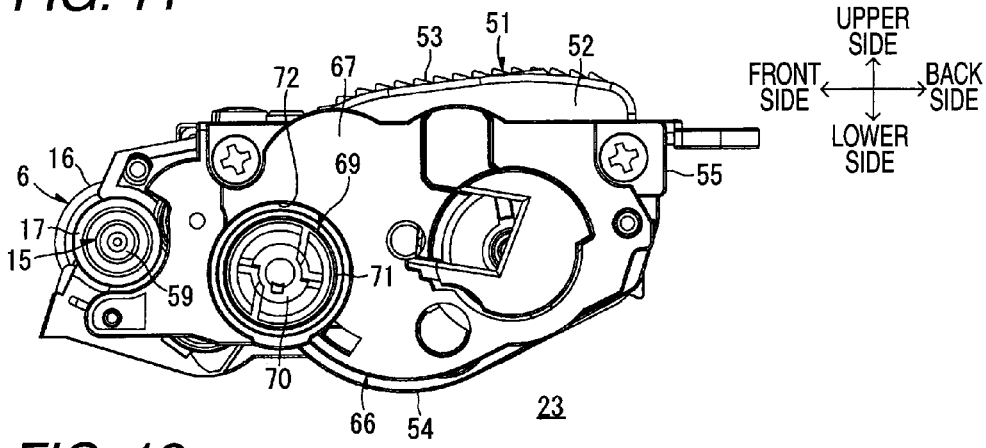
FIG. 11 is a left side view of the developing cartridge of FIG. 9.
Figure 12:
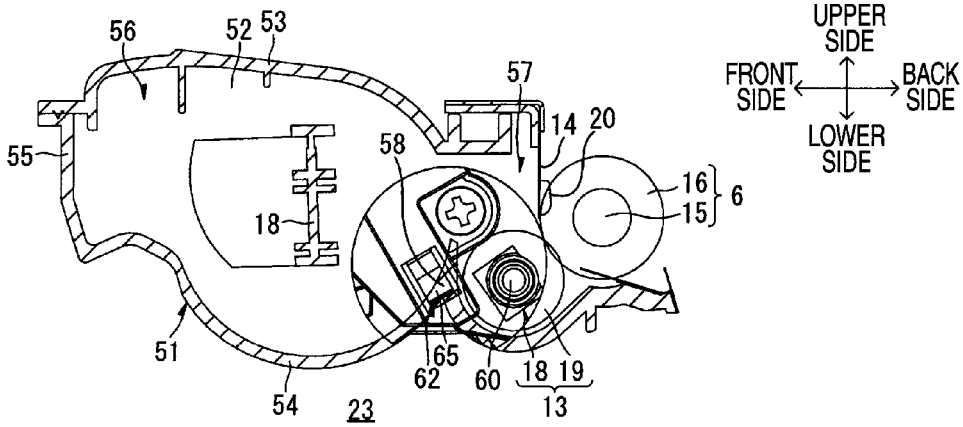
FIG. 12 is a vertical sectional view of the developing cartridge of FIG. 9.
Figure 13:
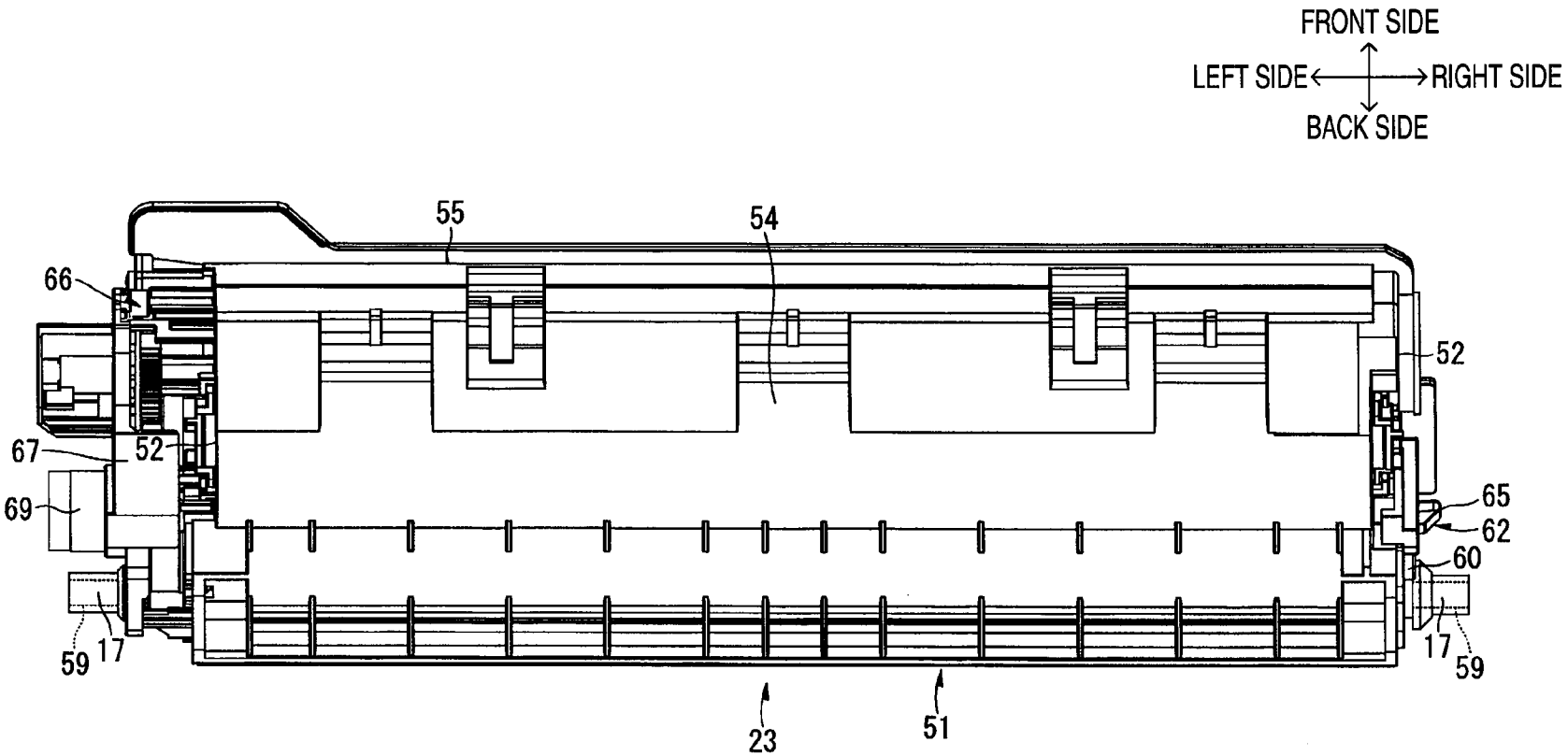
FIG. 13 is a bottom view of the developing cartridge of FIG. 9.
Figure 14:
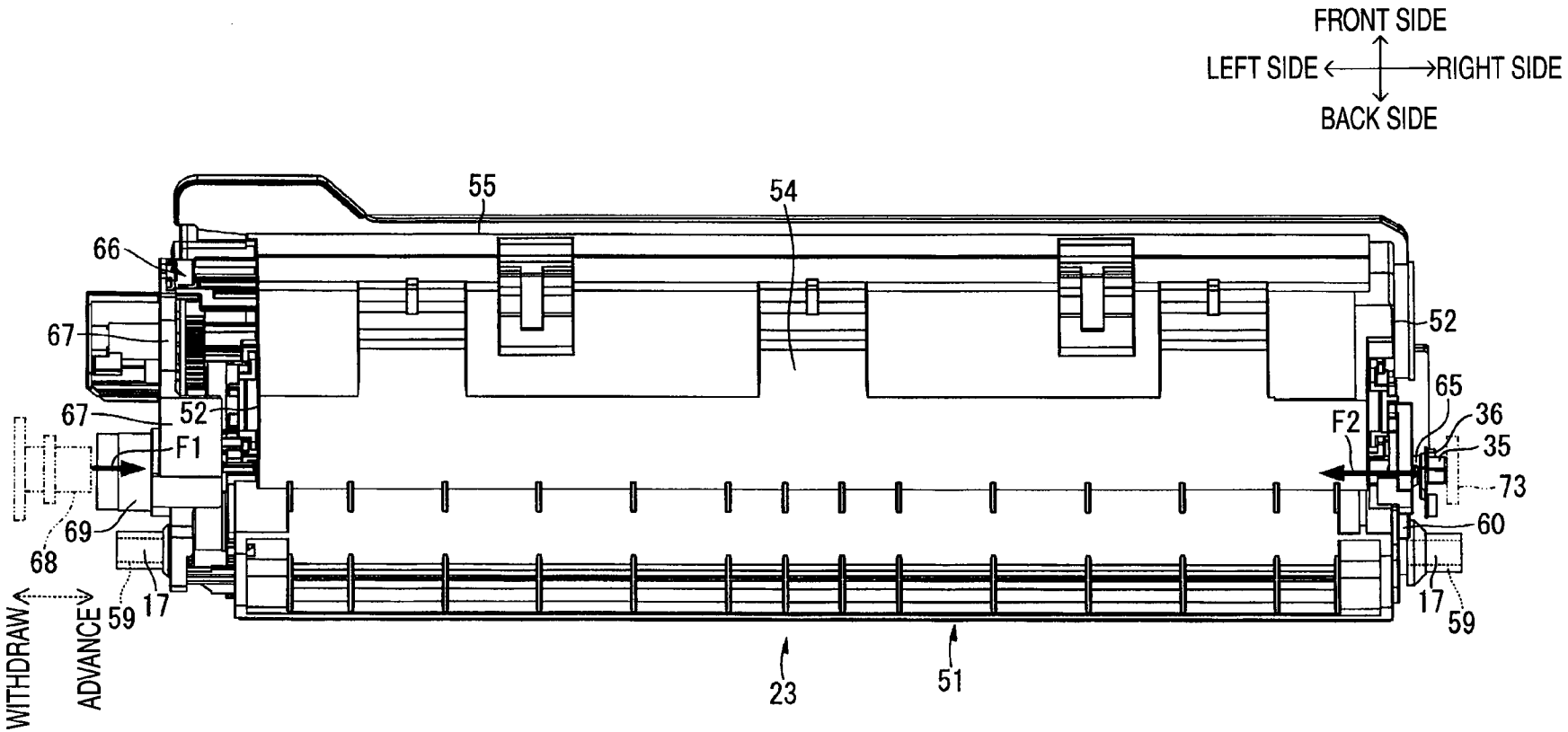
FIG. 14 is a bottom view of the developing cartridge of FIG. 9, in which the developing cartridge contacts with a relay electrode.

FIG. 9 is a perspective view of the developing cartridge as viewed obliquely from a right front direction. FIG. 10 is a right side view of the developing cartridge. FIG. 11 is a left side view of the developing cartridge. FIG. 12 is a vertical sectional view of the developing cartridge. FIG. 13 is a bottom view of the developing cartridge. FIG. 14 is a bottom view of the developing cartridge which is in contact with the relay electrode.

As shown in FIGS. 9 and 11, the developing cartridge 23 includes a housing 51 as an example of a frame. The housing 51 has a box shape which is opened on a rear side thereof. The housing 51 includes side walls 52 (refer to FIGS. 9 and 10) which are disposed spaced apart from each other in the width direction in such a manner as to face each other, an upper wall 53 which is provided in such a manner as to extend between upper ends of the side walls 52, a bottom wall 54 which is provided in such a manner as to extend between lower ends of the side walls 52 and a front wall 55 which is provided in such a manner as to extend between front ends of the side walls 52.

In the housing 51, a front space thereof is partitioned as a developer accommodation chamber 56 (see FIG. 12) as an example of a developer accommodation chamber which accommodates developer, and a rear space thereof is partitioned as a developing chamber 57 in which the developing roller 6 is provided.

A front portion of the bottom wall 54 which corresponds to the developer accommodation chamber 56 has a substantially circular arc shape which extends along a rotating locus of an agitator 12 (which will be described later) and a rear portion which corresponds to the developing chamber 57 has a substantially circular arc shape which extends along a rotating locus of a supply roller 13 (which will be described later).

In addition, a bulkhead 58 as an example of a reinforcement member is formed between the front portion and the rear portion of the bottom wall 54 in such a manner as to be continued from the front and rear portions, respectively. The bulkhead 58 projects upwards within the housing 51. The bulkhead 58 is disposed spaced apart from the upper wall 53 and juts up towards the upper wall 53 and is disposed in such a manner as to partition the interior of the housing 51 into the developer accommodation chamber 56 and the developing chamber 57.

Developer is filled in the developer accommodation chamber 56, and the agitator 12 is provided rotatably in a center in the front-back and up-down direction.

The supply roller 13 as an example of a supply member and a layer thickness restriction blade 14 are provided together with the developing roller 6 in the developing chamber 57.

The developing roller 6 is disposed at a rear end portion of the developing chamber 57 in such a manner as to be exposed from the rear of the housing 51. The developing roller 6 includes a developing roller shaft 15 and a rubber roller 16, the latter of which is an example of a developer carrying part which is provided on the periphery of the developing roller shaft 15. The rubber roller 16 is an example of a developer carrying part and is provided on the periphery of the developing roller shaft 15.

Since the developing roller shaft 15 is supported rotatably on the side walls 52, the developing roller 6 is supported rotatably on the housing 51. The developing roller shaft 15 thus is disposed along the width direction as a first direction, and the rubber roller 16 moves circumferentially round the developing roller shaft 15 in the front-back direction which intersects the width direction at right angles by the rotation of the developing roller shaft 15 about an axial center.

In addition, as shown in FIGS. 9 and 1, end portions of the developing roller shaft 15 project outwards in the width direction from the corresponding side walls 52, and a collar 17 is placed over the projecting portions 59 (i.e., of the projecting portions which project outwards in the width direction from the corresponding side walls 52) in order to cover the projecting portions 59.

As shown in FIG. 12, the supply roller 13 is disposed in such a manner as to be brought into contact with the developing roller 6 on a front side of the developing roller 6. The supply roller 13 includes a supply roller shaft 18 and a sponge roller 19 which is provided around the supply roller 18.

Since the supply roller shaft 18 is supported rotatably on the side walls 52, the supply roller 13 is supported rotatably on the housing 51. The supply roller shaft 18 thus is disposed along the width direction, and the sponge roller 19 moves circumferentially around the supply roller shaft 18 in the front-back direction.

In addition, as shown in FIGS. 9 and 12, a right-hand end portion of the supply roller shaft 18 projects outwards in the width direction from the right-hand side wall 52, and a length of the projecting portion 60 (i.e., of the projecting portion which projects outwards in the width direction from the side wall 52) is formed shorter than a length of the projecting portion 59 of the developing roller shaft 15.

As shown in FIG. 12, a layer thickness restriction blade 14 is supported by the upper wall 53 at an upper end portion thereof, and a press contact rubber 20 provided at a lower end portion of the layer thickness restriction blade 14 is brought into press contact with the developing roller 6 from the front thereof.

In the developing cartridge 23, when forming an image, developer filled in the developer accommodation chamber 56 is discharged into the developing chamber 57 by the rotation of the agitator 12 and the developer so discharged is then supplied to the developing roller 13. Thereafter, the developer is supplied to the developing roller 6 by the rotation of the supply roller 13. Then, the developer enters between the layer thickness restriction blade 14 and the developing roller 6 as the developing roller 6 rotates so as to be formed into a thin layer of a predetermined thickness. By this action, the developer is carried on a surface of the developing roller 6 as a thin layer.

As shown in FIGS. 9 and 10, a conductive member 61 and a bias electrode 62 are provided on the developing cartridge 23 on the right-hand side wall 52 (one of the side walls 52).

The conductive member 61 is formed from a conductive material into a flat plate shape and is provided at a rear portion on an external surface of the right-hand side wall 52 in such a manner that the projecting portion 59 of the developing roller shaft 15 and the projecting portion 60 of the supply roller shaft 18 are passed slidably therethrough.

In addition, an electrode cover 63 which swells outwards and which has a substantially L shape as viewed from the side is provided at a front end portion of the conductive member 61 in such a manner as to be inclined upwards to the front from a rear lower side thereof. An opening 64 is formed in a lower end portion of the electrode cover 63.

The bias electrode 62 is attached to the right-hand side wall 52 for support thereon and is covered with the electrode cover 63. The bias electrode 62 is made up of a leaf spring and includes a projecting portion 65 which projects outwards in the width direction from the opening 64 of the conductive material.

As shown in FIG. 13, a length of the projecting portion 65 (i.e., of the projecting portion which projects outwards in the width direction from the side wall 52) is made shorter than the length of the projecting portion 59 of the developing roller shaft 15 and is made longer than the length of the projecting portion 60 of the supply roller shaft 18.

The bias electrode 62 is electrically connected to the projecting portion 59 of the developing roller shaft 15 and the projecting portion 60 of the supply roller shaft 18 via the conductive member 61, and as will be described in more detail later. When a bias voltage is applied from the relay electrode 35 to the bias electrode 62, the bias voltage so applied is applied from the bias electrode 62 to the developing roller shaft 15 and the supply roller shaft 18 via the conductive member 61.

In addition, as shown in FIG. 11, in the developing cartridge 23, a gear mechanism part 66 and a gear cover 67 are provided on the left-hand side wall 52 (i.e., in the other side wall 52).

The gear mechanism part 66 includes an input gear 69 as a drive receiving part which receives a driving force from the developing coupling 68 (which will be described later) provided on the body casing 2, a developing roller gear (not shown) for driving the developing roller shaft 15, a supply roller gear (not shown) for driving the supply roller shaft 18 and an agitator gear (not shown) for driving the agitator.

The input gear 69 includes an internal toothed portion 70 on which the developing coupling 68 fits removably in the width direction and an external toothed portion 71 which meshes with other gears. In addition, when projected in the width direction, the input gear 69 is disposed in such a manner as to overlap the projecting portion 65 of the bias electrode 62 as is indicated by a chain line in FIG. 10. Furthermore, when projected in the width direction, part of the bulkhead 58 is disposed within a plane of projection where the input gear 69 and the projecting portion 65 of the bias electrode 62 overlap each other when projected in the width direction, as shown in FIG. 12.

In the gear mechanism part 66, the aforesaid gears are made to mesh with each other via an idle gearwheel or the like, so that a driving force from the developing coupling 68 is received by the input gear 69 so as to be transmitted from the input gear 69 to the developing gear (not shown), the supply roller gear (not shown) and the agitator gear (not shown). Thus, the developing roller 6, the supply roller 13 and the agitator 12 are caused to rotate in the way described above.

The gear cover 67 is attached to the right-hand side wall 52 in such a manner as to cover the gear mechanism part 66. An input opening 72 is formed in the gear cover 67 for the input gear 69 to be exposed therefrom, and the input gear 69 is made to project outwards in the width direction from the input opening 72.

(3) Mount of Developing Cartridge to Drum Cartridge

As shown in FIG. 2, the developing cartridge 23 is mounted to the developing cartridge accommodation part 26 of the drum cartridge 22.

In order for the developing cartridge 23 to be mounted to the developing cartridge accommodation part 26, the left and right collars 17 of the developing cartridge 23 shown in FIG. 9 are inserted, respectively, into the right-side guide portion 33 and the left-side guide hole 38 of the drum cartridge 22, which are shown in FIGS. 6 and 7, so as to be guided as deep as the right-side insertion hole 34 and the left-side insertion hole 39.

As shown in FIGS. 4 and 5, when the left and right collars 17 of the developing cartridge 23 are inserted as deep as the right-side insertion hole 34 and the left-side insertion hole 39, respectively, the developing cartridge 23 is accommodated in the developing cartridge accommodation part 26 as shown in FIG. 2.

When the developing cartridge 23 is accommodated in the developing cartridge accommodation part 26, the developing roller 6 is brought into contact with the photosensitive drum 3 in the rear of the developing cartridge accommodation part 26, as shown in FIG. 3. In the rear of the developing cartridge 23, a pressing member 41 of the drum cartridge 22 presses on the front wall 55 of the developing cartridge 23. Thus, the developing cartridge 23 is pressed toward the photosensitive drum 3, whereby the developing roller 6 and the photosensitive drum 3 are brought into press contact with each other.

In addition, when the developing cartridge 23 is accommodated in the developing cartridge accommodation part 26, the internal electrode 36 of the relay electrode 35 is brought into contact with the projecting portion 65 of the bias electrode 62 from the outside in the width direction as shown in FIG. 14. The projecting portion 65 is pressed further leftward (i.e., to the other side in the width direction) than the internal electrode 36. The projecting portion 65 is elastically compressed, and the housing 51 is pressed leftward by a reaction force generated by the projecting portion 65 so elastically compressed.

As is depicted in a partially enlarged view shown in FIG. 3, the left-hand collar 17 is brought into abutment with a peripheral portion of the guide hole 38 in the left-hand front side wall 31, whereby the developing cartridge 23 is positioned in the width direction relative to the drum cartridge 22.

In addition, when the developing cartridge 23 is accommodated in the developing cartridge accommodation part 26, the input gear 69 is, as shown in FIG. 5, disposed in such a manner as to confront the coupling passage hole 40 in the width direction. The input gear 69 is thus exposed to an outside of the drum cartridge 22 through the coupling passage hole 40.

(4) Mount of Process Cartridge to Body Casing

In addition, as shown in FIG. 1, the top cover 50 is opened and the process cartridge 21 is mounted to the body casing 2. Thereafter, when the top cover 50 is closed, the developing coupling 68 which is provided on the body casing 2 moves rightward as is indicated by chain double-dashed lines in FIG. 14 in association with the closure of the top cover 50 and then fits with the internal toothed portion 70 of the input gear 69.

Thus, a first pressure F1 under which the input gear 69 is pressed rightward by the developing coupling 68 is set to be smaller than a second pressure F2 under which the projecting portion 65 of the bias electrode 62 is pressed leftward by the abutment with the internal electrode 36.

When forming an image, the rotational driving force of the developing coupling 68 is transmitted to the input gear 69, whereby the developing roller 6, the supply roller 13 and the agitator 12 are caused to rotate in the way described above.

In addition, when the top cover 50 is opened, the developing coupling 68, being interlocked with the opening of the top cover 50, is withdrawn leftward to thereby be removed from the internal toothed portion 70 of the input gear 69.

Additionally, when the process cartridge 21 is mounted to the body casing 2, as is indicated by chain double-dashed lines in FIGS. 2 and 14, the body side electrode 73 provided on the body casing 2 is brought into contact with the external electrode 37 of the relay electrode 35 from the outside in the width direction.

The body side electrode 73 is connected to a high-voltage power supply provided on the body casing 2, and when forming an image, a bias voltage applied from the high-voltage power supply is applied to the relay electrode 35 via the body side electrode 73. When the bias voltage is applied to the relay electrode 35, the bias voltage is then applied from the relay electrode 35 to the bias electrode 62, and thereafter, as has been described above, the bias voltage is applied to the developing roller shaft 15 and the supply roller shaft 18.

As has been described heretofore, in the process cartridge 21, the relay electrode 35 is provided on the drum cartridge 22. According thereto, when the developing cartridge 23 is mounted to the drum cartridge 22, the projecting portion 65 of the bias electrode 62 is brought into contact with the internal electrode 36 of the relay electrode 35, while when the process cartridge 21 is mounted to the body casing 2, the body side electrode 73 is brought into contact with the external electrode 37 of the relay electrode 35, whereby feeding is implemented from the body side electrode 73 to the relay electrode 35 via the bias electrode 62.

In the relative arrangement between the bias electrode 62 of the developing cartridge 23 and the body side electrode 73 of the body casing 2, the bias electrode 62 and the body side electrode 73 are disposed without considering a relationship therebetween. However, even in the event that the relay electrode 35 of the drum cartridge 22 is disposed in such a manner as to be brought into contact with the bias electrode 62 and the body side electrode 73, feeding can be implemented from the body side electrode 73 to the bias electrode 62 via the relay electrode 35.

Accordingly, a limitation imposed on the developing cartridge 23 with respect to the layout of the bias electrode 62 which is disposed therein can be avoided. Furthermore, a limitation imposed on the body casing 2 with respect to the layout of the body side electrode 73 which is disposed therein can also be avoided. As a result, a limitation imposed on the whole image forming apparatus with respect to the layout of the components of the image forming apparatus can be avoided.

In addition, since the bias electrode 62 can be disposed freely, in the process cartridge 21, the bias electrode 62 and the input gear 69 may be disposed in such a manner as to overlap each other when they are projected in the width direction.

Accordingly, the developing cartridge 23 can be positioned with good balance in the width direction relative to the drum cartridge 22.

In the process cartridge 21, the bias electrode 62 is pressed leftward, that is, toward the input gear 69 by the contact with the relay electrode 35. According thereto, even though the input gear 69 receives the driving force from the developing coupling 68, the developing cartridge 23 can be positioned stably relative to the drum cartridge 22 by the pressure applied to the bias electrode 62 by the relay electrode 35. Furthermore, it is possible to feed from the relay electrode 35 to the bias electrode 62 stably. Moreover, the input gear 69 can more surely receive the driving force from the developing coupling 68.

In the process cartridge 21, the first pressure F1 under which the input gear 69 is pressed toward the bias electrode 62 by the developing coupling 68 is smaller than the second pressure F2 under which the bias electrode 62 is pressed toward the input gear 69 by the abutment with the relay electrode 35. Thus, the movement of the developing cartridge 23 by the driving force received by the input gear 69 can be suppressed.

Accordingly, the developing cartridge 23 can be positioned relative to the drum cartridge 22 more stably. In addition, it is possible to feed from the relay electrode 35 to the bias electrode 62 stably. Moreover, the input gear 69 can surely receive the driving force from the developing coupling 68.

The bulkhead 58 is provided along the width direction within the plane of projection in which the bias electrode 62 and the input gear 69 overlap each other when they are projected in the width direction in the housing 51 of the developing cartridge 23. Accordingly, the rigidity in the width direction within the plane of projection can be ensured.

Accordingly, the pressure exerted on the bias electrode 62 by the relay electrode 35 can surely be transmitted to the input gear 69 in the width direction.

Consequently, the developing cartridge 23 can be positioned relative to the drum cartridge 22 much more stably. In addition, it is possible to feed from the relay electrode 35 to the bias electrode 62 in a more stable manner. Moreover, the input gear 69 can receive the driving force from the developing coupling 68 in a more ensured manner.

Furthermore, since the bulkhead 58 which partitions the interior of the developing cartridge 23 into the developer accommodation chamber 56 and the developing chamber 57 doubles as the reinforcement member which ensures the rigidity in the width direction within the plane of projection, a reduction in the number of components and a simplification of the configuration of the developing cartridge 23 can be realized.

Since the length of the projecting portion 59 of the developing roller 6 is made longer than the projecting portion 65 of the bias electrode 35, when the developing cartridge 23 is mounted to the developing cartridge accommodation part 26, by the projecting portion 59 of the developing roller 6 being covered with the collar 17, the developing cartridge 23 can be more surely guided into the developing cartridge accommodation part 26.

In addition, since the length of the projecting portion 65 of the bias electrode 62 is made longer than the length of the projecting portion 60 of the supply roller 13, when the developing cartridge 23 has been mounted to the developing cartridge accommodation part 26, the projecting portion 65 of the bias electrode 62 can be brought into contact with the internal electrode 36 of the relay electrode 35 in an ensured manner.

The bias electrode 62 is made up of the leaf spring material. According thereto, by bringing the projecting portion 65 of the bias electrode 62 into elastic contact with the internal electrode 36 of the relay electrode 35, the bias electrode 62 can be made to be pressed leftward in an ensured manner by the reaction force generated by the elastic contact of the projecting portion 65 with the internal electrode 36.

In addition, in the event that the relay electrode 35 is made up of a leaf spring material, when the developing cartridge 23 is mounted to or removed from the developing cartridge accommodation part 26, since the bias electrode 62 is made up of the leaf spring material, there is less opportunity for the developing cartridge 23 to become caught on the relay electrode 35 when the developing cartridge 23 is so mounted or removed.

In addition, in the image forming apparatus 1, the limitation imposed on the body casing 2 with respect to the layout of the body side electrode 73 which is disposed therein can be mitigated. Accordingly, the limitation with respect to the layout of components of the image forming apparatus can be mitigated.

In addition, the developing cartridge 23 can be positioned relative to the drum cartridge 22 far more stably, and furthermore, it is possible to feed from the relay electrode 35 to the bias electrode 62 more stably. Moreover, the input gear 69 can receive the driving force from the developing coupling 68 in a more ensured manner. Accordingly, a stable image formation can be attained.

II. Modified Exemplary Embodiments

In the above-described exemplary embodiments, while the direct tandem-type color printer which includes the four photosensitive drums has been illustrated as an example of an image forming apparatus, the present inventive concept may alternatively be applied to any electrophotographic printer including intermediate transfer tandem-type color printers, monochrome printers or the like.

In addition, in the above-described exemplary embodiments, while the LED 5 is used to expose the photosensitive drum 3, a laser scanner can also be used for exposure of the photosensitive drum 3.

According to another aspect of the invention, in the process cartridge, a first pressure under which the driving force receiving part is pressed toward the first electrode by the driving force output part is smaller than a second pressure under which the first electrode is pressed toward the driving force receiving part by the second electrode.

That is, since the first pressure under which the driving force receiving part is pressed toward the bias electrode by the driving force output part is smaller than the second pressure under which the bias electrode is pressed toward the driving force receiving part by abutment with the relay electrode, the movement of the developing cartridge can be suppressed which would otherwise be generated by the driving force received by the driving force receiving part.

According thereto, the developing cartridge can be positioned further stably relative to the photosensitive cartridge. In addition, it is possible to feed from the relay electrode to the bias electrode stably. Moreover, the driving force receiving part can more surely receive the driving force from the driving force output part.

According to still another aspect of the invention, in the process cartridge, the developing cartridge comprises a frame that supports the first electrode, the frame comprising a reinforcement member that extends parallel to the axis of the developer carrier such that the reinforcement member, the first electrode and the driving force receiving part overlap each other when viewed from the side of the developing cartridge.

That is, the reinforcement member which extends along the first direction is provided on the frame within the plane of projection where the bias electrode and the driving force receiving part overlap each other when they are projected in the first direction. According thereto, the rigidity in the first direction within the plane of projection where the bias electrode and the driving force receiving part overlap each other when they are projected in the first direction can be ensured. Thus, the pressure applied to the bias electrode by the relay electrode can be transmitted to the driving force receiving part in the first direction more surely. In addition, it is possible to feed from the relay electrode to the bias electrode in a more stable manner. Moreover, the driving force receiving part can receive the driving force from the driving force output part in a more ensured manner.

According to still another aspect of the invention, an interior of the frame is partitioned by the reinforcement member into a developer accommodation chamber that accommodates developer and a developing chamber.

According thereto, since the reinforcement member doubles as the bulkhead, a reduction in the number of components and simplification in configuration of the process cartridge and the developing cartridge can be realized.

According to still another aspect of the invention, in the process cartridge, a portion of the first electrode projects outside the frame on the one side of the developer carrier, the developing cartridge further comprises a supply member that supplies developer to the developer accommodation chamber, an end portion of the supply member projects outside of the frame on the one side of the developer carrier, an end portion of the developer carrier projects outside of the frame on the one side of the developer carrier, a length of the end portion of the developer carrier which projects outside of the frame is longer than a length of the first electrode which projects outside of the frame, and a length of the portion of the first electrode which projects outside of the frame is longer than the length of the end portion of the supply member which projects outside of the frame.

According thereto, since the length of the portion of the developer carrier which projects outside from the frame is longer than that of the bias electrode, when the developing cartridge is mounted to the photosensitive cartridge, the developing cartridge can be guided on to the photosensitive cartridge in a more ensured manner by the projecting portion of the developer carrier.

In addition, since the length of the portion of the bias electrode which projects outside from the frame is longer than that of the supply member, the bias electrode can be brought into contact with the relay electrode in an ensured manner when the developing cartridge has been mounted to the photosensitive cartridge.

According to still another aspect of the invention, in the process cartridge, the first electrode comprises a leaf spring material.

That is, the bias electrode is made of a leaf spring material. Accordingly, by bringing the bias electrode into elastic contact with the relay electrode, the bias electrode can be made to be pressed toward the driving force receiving part in the first direction in a more ensured manner using a reaction force of a pressure generated by the elastic contact of the bias electrode with the relay electrode.

In addition, since the relay electrode is made of a leaf spring, the developing cartridge is less likely to become caught on the relay electrode when the developing cartridge is mounted to or removed from the relay electrode.

According to still another aspect of the invention, in the developing cartridge, an interior of the frame is partitioned by the reinforcement member into a developer accommodation chamber that accommodates developer and a developing chamber that accommodates the developer carrier.

That is, the bias electrode is made of a leaf spring material. According thereto, by bringing the bias electrode into elastic contact with the relay electrode, the bias electrode can be made to be more surely pressed toward the driving force receiving part in the first direction using a reaction force of a pressure generated by the elastic contact of the bias electrode with the relay electrode.

While the present invention has been shown and described with reference to certain exemplary embodiments thereof, it will be understood by those skilled in the art that various changes in form and details may be made therein without departing from the spirit and scope of the invention as defined by the appended claims.

The invention claimed is:

1. A developing cartridge comprising:

a developer carrier;

a frame having a reinforcement member for partitioning an interior of the frame into a developer accommodation chamber configured to accommodate developer and a developing chamber configured to accommodate the developer carrier;

an electrode that is provided on the frame on a first side of the developing cartridge for applying a bias to the developer carrier; and a driving force receiving part provided on the frame at a second side of the developing cartridge for receiving a driving force to drive the developer carrier, wherein the electrode and the reinforcement member are aligned to overlap each other when viewed from a side of the developing cartridge.

2. The developing cartridge according to claim 1, wherein the electrode comprises a leaf spring material.

3. A developing cartridge comprising:

a developer carrier;

a frame having a reinforcement member for partitioning an interior of the frame into a developer accommodation chamber configured to accommodate developer and a developing chamber configured to accommodate the developer carrier;

an electrode that is provided on the frame on a first side of the developing cartridge for applying a bias to the developer carrier; and a driving force receiving part provided on the frame at a second side of the developing cartridge for receiving a driving force to drive the developer carrier, wherein the driving force receiving part and the reinforcement member are aligned to overlap each other when viewed from a side of the developing cartridge.

4. The developing cartridge according to claim 3, wherein the electrode comprises a leaf spring material.

* * * * *